US006105515A

United States Patent [19]

Kaylor

[11] Patent Number: 6,105,515

[45] Date of Patent: Aug. 22, 2000

[54] PORTABLE CYCLONE BURNER

[76] Inventor: Timothy R. Kaylor, P.O. Box 573, Ducktown, Tenn. 37326

[21] Appl. No.: 08/616,287

[22] Filed: Mar. 15, 1996

[51] Int. Cl.[7] ..... F23J 3/04

[52] U.S. Cl. ..... 110/217; 110/241; 110/242; 110/244

[58] Field of Search ..... 110/233, 241, 110/242, 244, 217, 235

[56] References Cited

U.S. PATENT DOCUMENTS

| | | | |
|---|---|---|---|
| 3,498,240 | 3/1970 | Trott | 110/241 X |
| 3,869,995 | 3/1975 | Straitz, III | 110/244 X |
| 5,347,935 | 9/1994 | Whitaker | 110/241 X |

*Primary Examiner*—Henry A. Bennett
*Assistant Examiner*—Susanne C. Tinker
*Attorney, Agent, or Firm*—Frank A. Lukasik

[57] ABSTRACT

A device for enabling oil spill waste materials to be incinerated in situ is provided. More specifically, the invention comprises an incinerator for reducing to ashes, used oil spill sorbent pads, oilsocks, and other materials employed in cleaning up oil spills. The device consists essentially of a stainless steel drum lid and flue secured thereto, with a dome screen mounted on the flue. The outlet of a stainless steel tube is formed into a spiral coil and deployed in the flue with the end thereof turned downward into the drum to cause a continuous circulating action in the drum which action provides fast, complete or substantially complete combustion of the materials with little pollution and leaving a residue of only a few inches of ashes. The device is carried on a hand truck and the blower motor is contained in a housing which is fastened to the hand truck.

4 Claims, 5 Drawing Sheets

PORTABLE CYCLONE BURNER

BACKGROUND OF THE INVENTION

1. Field of the Invention

This invention relates to a device for incinerating used oil sorbent pads, oil socks and other materials used for cleaning up oil spills. The device comprises a steel drum lid and a flue which includes a dome screen, with the lid adapted to be mounted on and secured to existing waste containers thereby enabling waste to be burned and disposed of in situ.

2. Description of the Prior Art

Several varieties of cyclone furnaces and cyclonic incinerators are known, such as for burning fuels, supplying hot gaseous products of combustion for use in dehydration, some introducing waste tangentially through a tube or other suitable means into horizontally or vertically disposed chambers, and others having internal structures that are modified to promote greater combustion, among other forms and uses. For example, U.S. Pat. No. 2,707,444 to Van Loon discloses a cyclone furnace for burning fine grained fuels that are entrained in a portion of the combustion medium which is introduced tangentially into a refractory-material lined chamber. The remaining part of the medium is introduced tangentially into the chamber through a second inlet, and liquid slag is discharged through an outlet that is tangential to the interior chamber wall in a direction opposite to the direction of helical movement of fuel particles.

U.S. Patent No. 3,179,150 to Arnold concerns a furnace for use in dehydration in which combustion is completed within a refractory-lined combustion chamber so that no flame will be communicated through a flue. Within the chamber, vortex currents of secondary air are opposed to currents of primary air and to burning gases traversing the cylindrical chamber circumferentially in the opposite sense of rotation from the vortex currents of secondary air. When the opposing currents meet at substantial velocities, the impact of the gases upon each other promotes agitation with consequent intermixing so as to result in completion of combustion before the gases resume motion toward the flue.

In U.S. Pat. No. 3,865,054 to Monroe, Jr., a cyclonic incinerator having a start-up temperature of 1,600° F. to 3,000° F. is disclosed wherein the selected temperature is achieved through use of an auxiliary burner. Waste introduced tangentially through feeding means at one end of the chamber is caught up in the rapid cyclonic flow of hot gases in the chamber and is rapidly combusted. The waste can be propelled into the chamber by air or fuel, and rows of nozzles direct air tangentially into the combustion chamber wherein combustion preferably is started by an auxiliary burner axially positioned in one end of the chamber. U.S. Pat. No. 4,002,127 to Angus concerns a cyclone structure for use in controlling the flow of two fluid streams to create a localized inward radial flow and thus is remote from the purpose and features of the present invention.

It can readily be appreciated that these references, either singly or in combination, do not suggest or infer the cyclone furnace of the present invention which provides for, in the preferred embodiment, the combustion in situ of materials used for cleaning up oil spills while causing little pollution and leaving a residue of only a few inches of ashes. Reviewing the cited patents, in Van Loon, the combustion furnace is adapted to the burning of fine grained fuels, such as entrained granular fuel particles, the chamber is specifically contoured to accommodate and mix gases and as shown and taught could not accommodate waste materials, requires at least two tangential inlets and an outlet for liquid slag, and could not be easily manually transported, among other distinctions from the present invention. The device in Arnold also is unsuited for burning waste materials for virtually all of the reasons cited above in relation to Van Loon and, in addition, the refractory lined chamber is configured so that no flame will be communicated through the flue. The cyclonic incinerator in Monroe, Jr. has temperature requirements that alone distinguish it from the present invention and, in addition, requires rows of nozzles for directing air tangentially into the combustion chamber and an auxiliary burner axially positioned in one end of the chamber. As stated infra, the Angus device is configured to control the flow of two fluid streams so as to create a localized inward radial flow thereof.

SUMMARY OF THE INVENTION

Accordingly, it is an object of the present invention to provide a device for incinerating waste materials used for cleaning up oil spills wherein the waste may be disposed of in situ.

It is another object of the invention to provide such a device that is adapted to be mounted on existing waste containers that are manually portable.

It is a still further object of the invention to provide a device for incinerating used oil sorbent pads, oilsocks and other such cleanup materials that may be mounted on the open end of a drum, thereby avoiding unnecessary appendages to a collection drum such as tangential inlets and outlets.

It is yet another object of the invention to provide such a device wherein a continuous circulating action of forced air is created within the drum so as to support combustion sufficient to rapidly and completely burn the waste materials in the drum, leaving therein upon completion of the burning, only a few inches of ashes.

The foregoing objects are realized by the present invention in a system wherein a stainless lid having a stainless steel flue secured thereto, preferably by welding, is positioned over the open end of, among other containers, a 55 gallon steel drum. A stainless steel air line is inserted through an opening in the side wall of the flue and a flexible portion thereof is formed into a spiral within the flue and enters the drum at its end to circulate air in a cyclonic form in the drum whereby the burning of oily waste in the drum will be accelerated and the waste reduced to ashes. The other end of the stainless steel air line is connected to a blower housing wherein a conventional blower is mounted for supplying a desired velocity to the ambient air that is forced into the drum. The entire assembly and drum may be mounted on and transported by a conventional hand truck.

BRIEF DESCRIPTION OF THE DRAWINGS

The foregoing and further objects of the invention will become apparent from reading the following detailed description of the preferred embodiment thereof, in which.

DETAILED DESCRIPTION OF THE INVENTION

Figure 1:
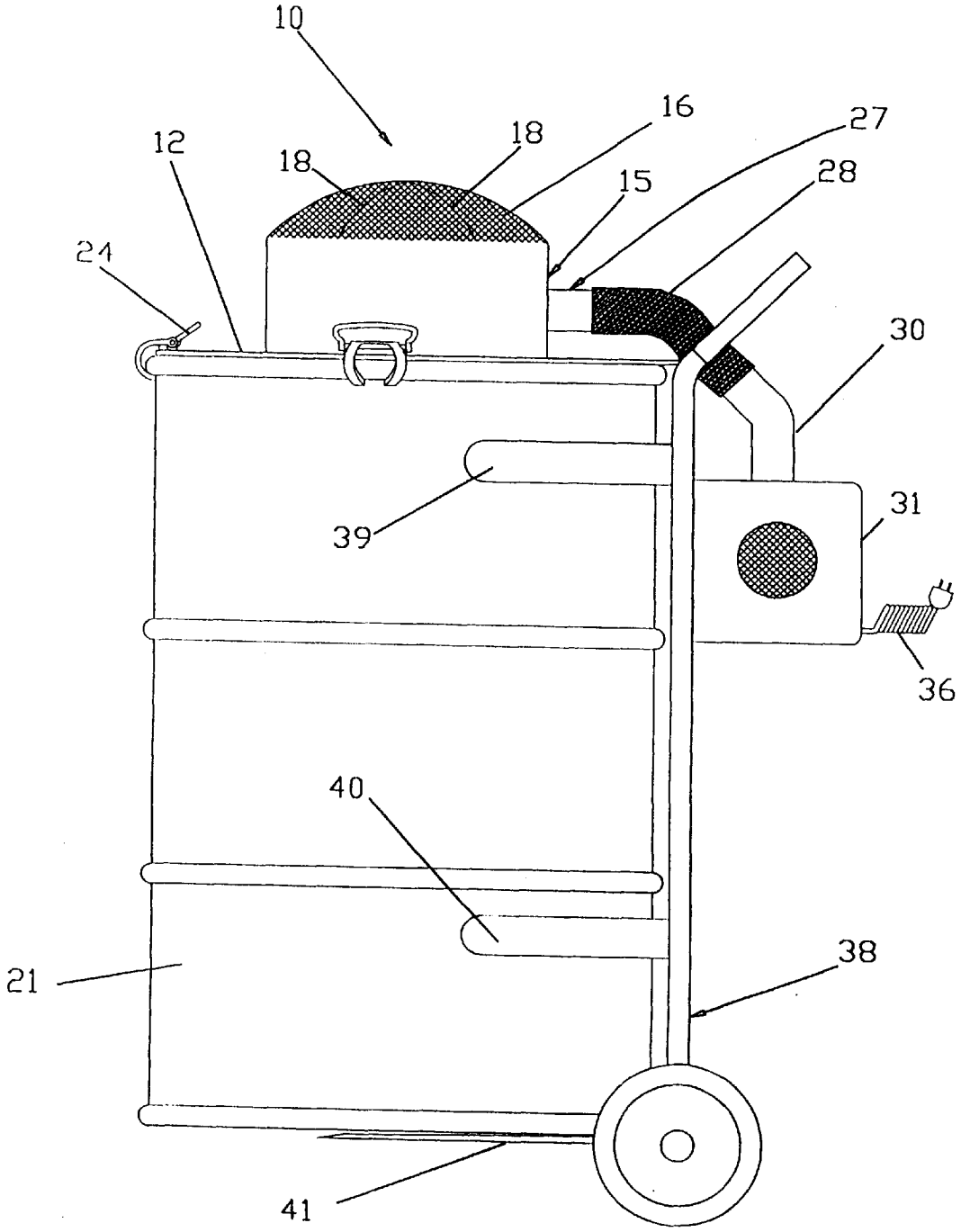
FIG. 1 is a side elevation of the preferred embodiment of the invention.

Turning now to FIG. 1 of the drawings, there is shown a preferred embodiment of the invention 10 comprising a lid 12, preferably made of stainless steel and having a flue 15 made of the same material and preferably welded to the lid in a circular opening therein, not shown in this view. A stainless steel screen 16 preferably is welded to and forms a dome over flue 15, with screen 16 being held in shape by a pair of braces 18 made of the same material and preferably welded thereto. Lid 12 is secured to the open end of a standard size drum 21, by a plurality of locking clamps 24, of which only two are shown. A stainless steel air line 27 is passed through an opening, not shown, in flue 15 and includes a flexible portion 28 which is connected to an outlet 30 of a blower housing 31. A conventional blower and blower motor, not shown, are secured in blower housing 31 and connected to a conventional power source by a cord 36. Blower housing 31 is secured to a conventional hand truck 38, and drum 21 is positioned vertically in hand truck 38 by a pair of brackets 39 and 40 while supported in the truck by at least a pair of prongs or tongues 41, only one of which is seen.

Figure 2:
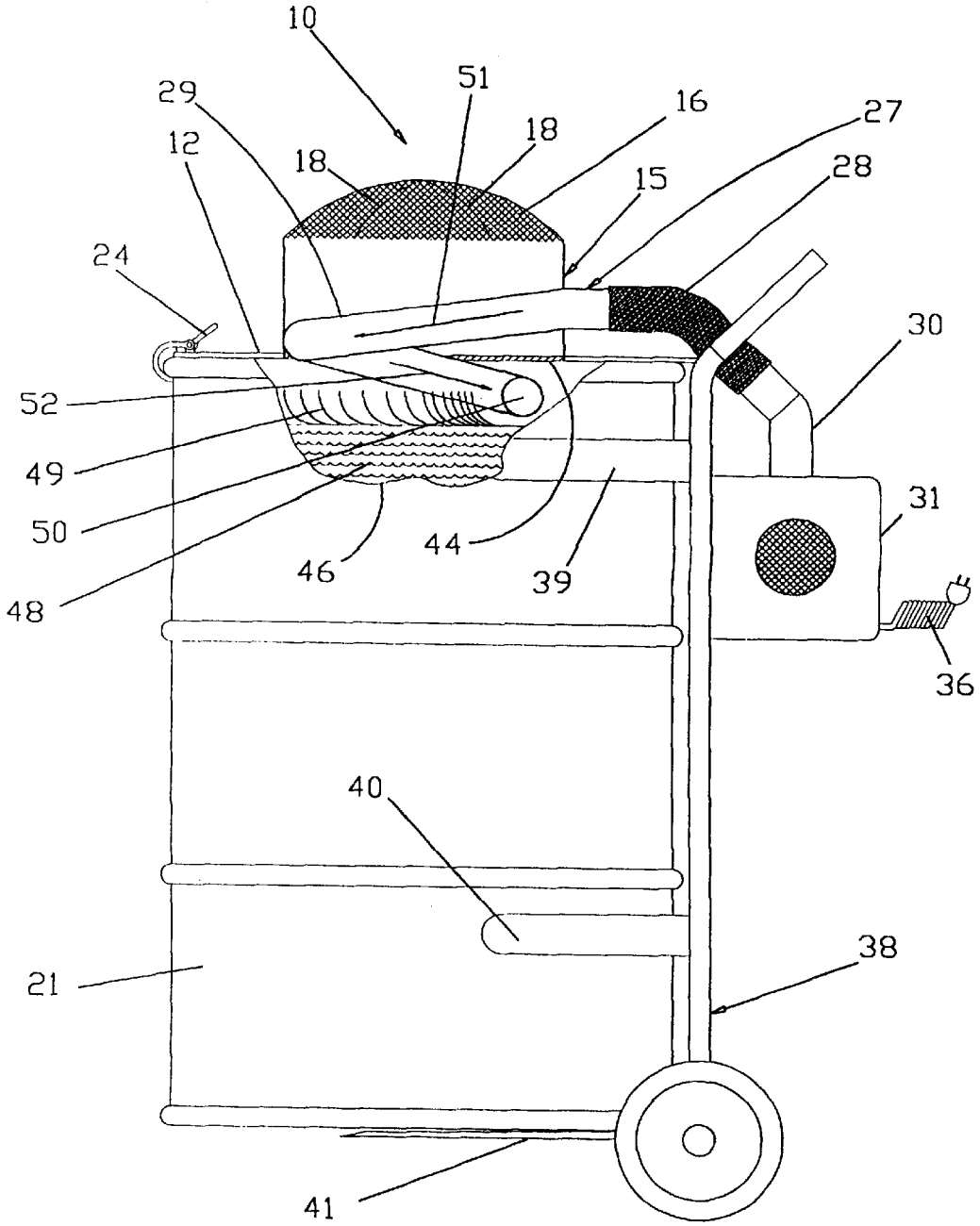
FIG. 2 is a side elevation of the embodiment of FIG. 1, partly cutaway.

FIG. 2 shows the invention in greater detail, including the opening 44 in lid 12, a spiral portion 29 of air line 27 which is curved to follow the contour of flue 15 for on the order of 270° after which, and while still in a spiral, portion 29 extends a selected distance into the interior of the drum as shown in cutaway portion 46. A fire in drum 21 is indicated at 49. The exit of portion 29 is shown at 50, and the direction of flow of cyclone-forming air is indicated by arrows 51 and 52.

Figure 3:
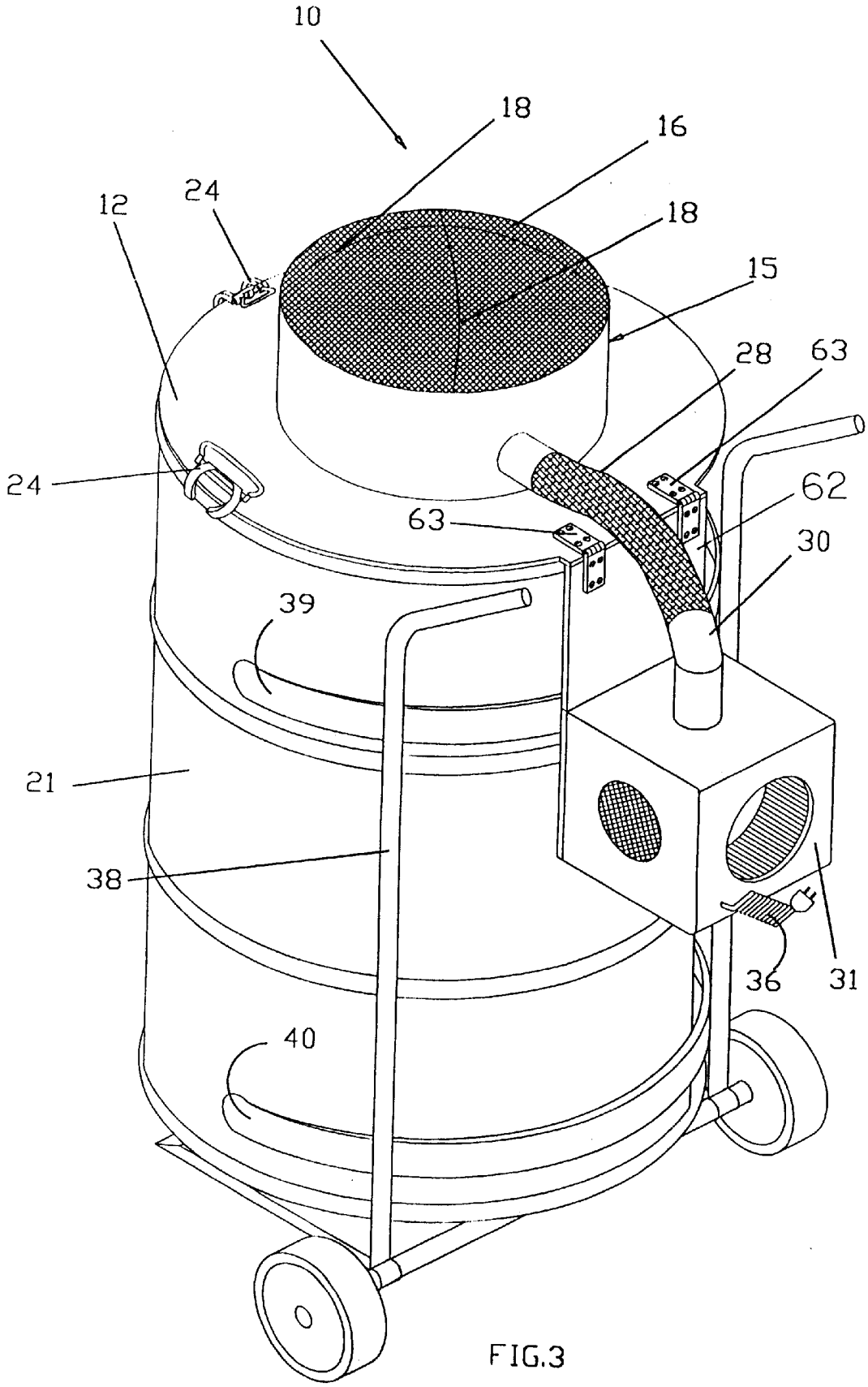
FIG. 3 is a perspective view of the embodiment of FIG. 2 secured to a drum and the drum mounted on a hand truck.

FIG. 3 illustrates in greater detail the combination of the invention with a 55 gallon drum and hand truck 38 having the blower unit 31 secured thereto. Lid 12 in this embodiment is hinged to a preferably stainless steel panel 62 by a pair of hinges 63, and panel 62 is secured to bracket 39 of the hand truck 38 by conventional means, not shown.

Figure 4:
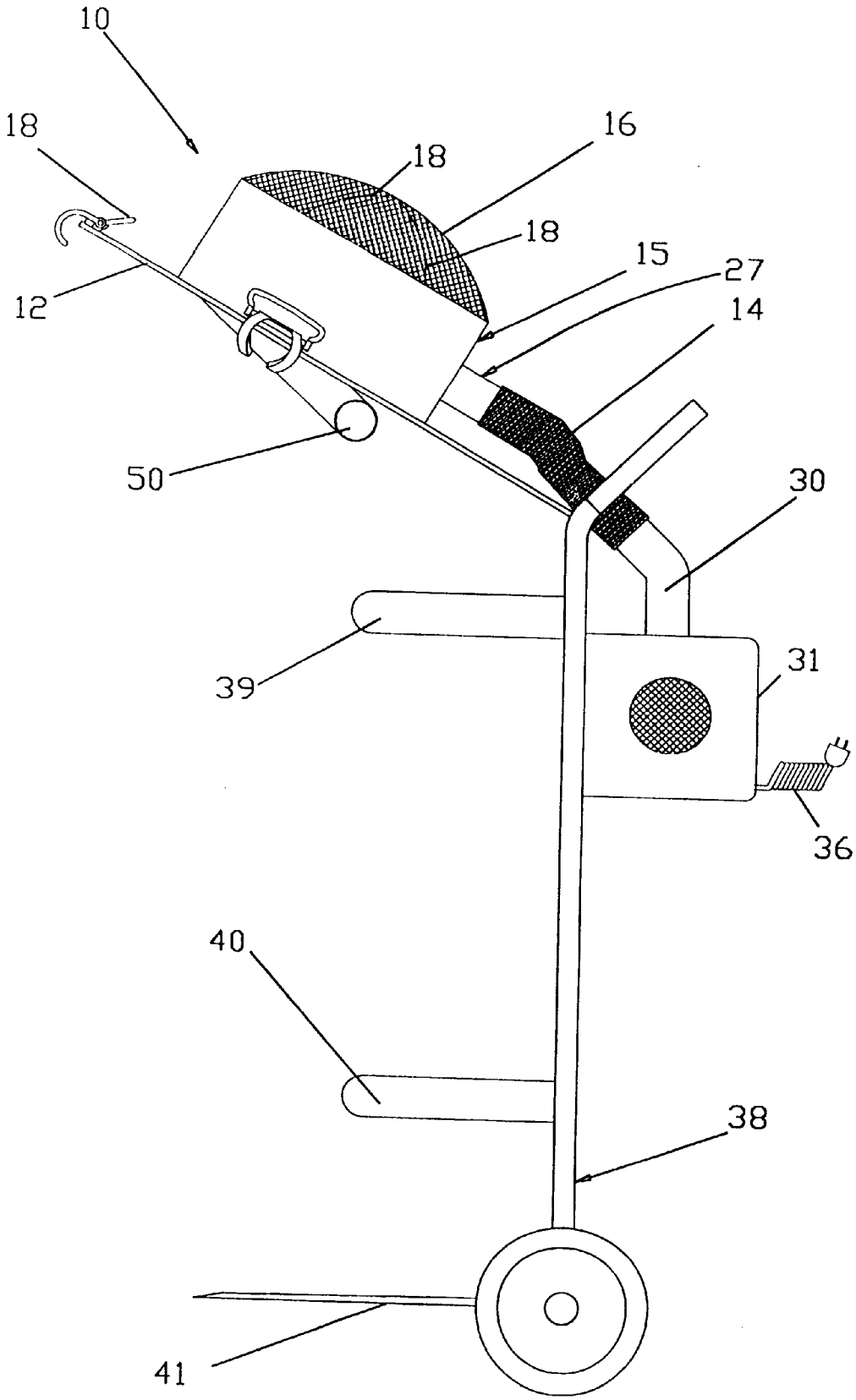
FIG. 4 is a side elevation of the embodiment of FIG. 1 before assembly with a drum.

FIG. 4 shows the invention 10 and blower housing 31 mounted on hand truck 38, with the end of portion 29 extending downwardly so as to cause forced air to be circulated in a cyclonic manner within a drum, not shown.

Figure 5:
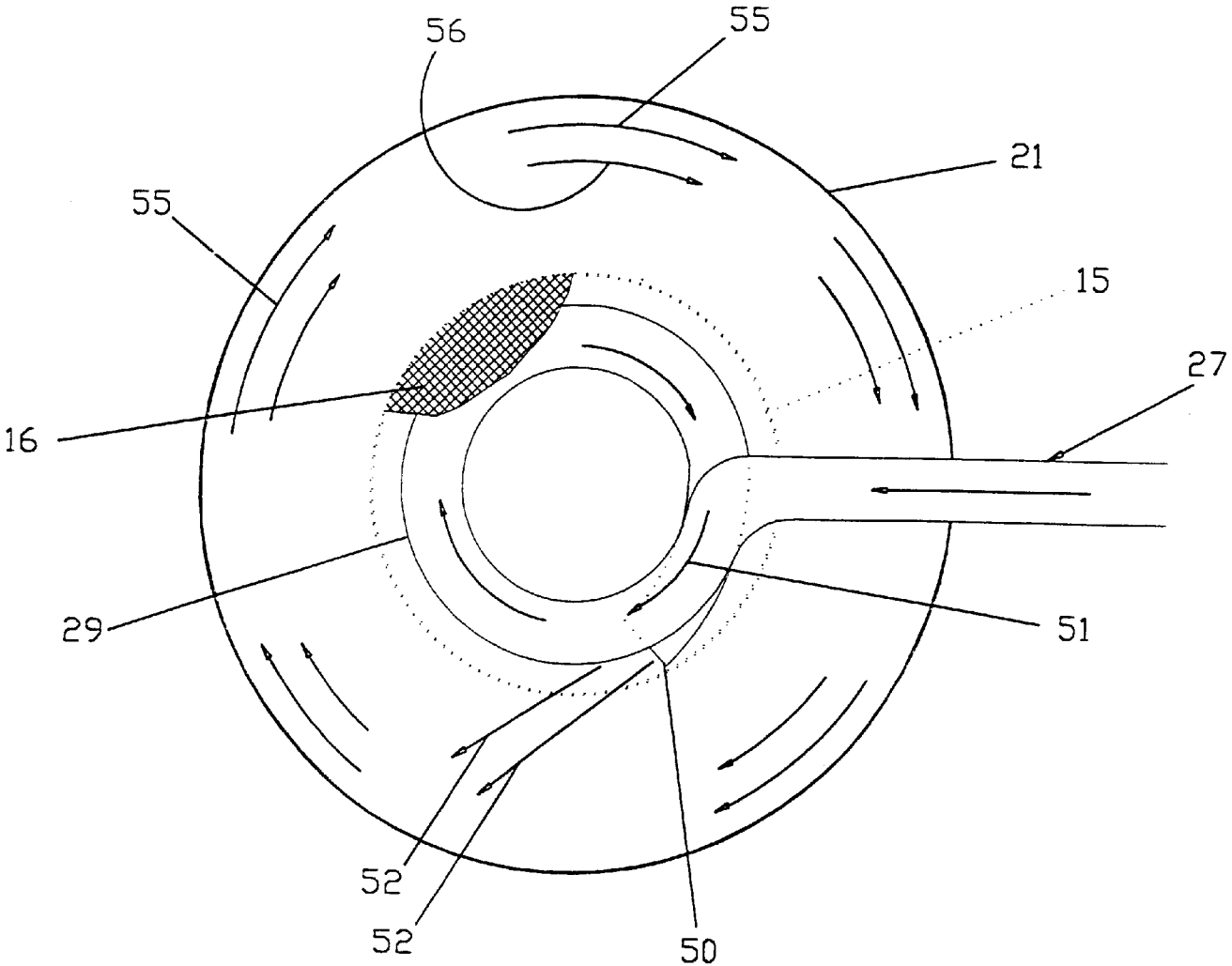
FIG. 5 is a plan view partly in phantom of the invention.

FIG. 5 illustrates in greater detail the manner in which portion 29 of air line 27 is routed within flue 15, causing air to flow in the direction of arrows 51 and 52 in the air line and, in the drum, in the direction of a plurality of arrows 55 and 56.

In operation, as shown in FIGS. 3 and 4, in a drum mounted on a hand truck 38 and having oil spill waste preignited therein, lid 12 is lowered onto the top of the drum, secured by clamps 24 and the blower in blower housing 31 is started. Air line 27 has solid walls where it enters flue 15 and where it is connected to blower housing 31. The portions of the air line indicated at 28 and 29 may be made flexible by being constructed of interlinked smaller segments as is well known in the art or of other suitable forms of flexible stainless steel tubing. Portion 29 enters the drum as indicated at 50 to cause the forced air to exit the air line under the influence of the curved passage. The curvature of portion 29 directs forced air outwardly downward which in turn causes a centrally cyclonic flow of gases and small particles toward and through screen 16.

Although this invention has been disclosed and described generally in relation to a preferred embodiment, its principles are susceptible of other applications which will be apparent to persons skilled in the art. For example, the end 50 of air line 27 may be either cut off at an angle or shaped differently to better distribute the flow of air into drum 21, and said air line may be made all flexible and sealed at its entry into said flue and at its exit from said blower housing. Hence, many modifications, additions, and deletions may be made to the invention without departure from the scope of the invention as set forth in the following claims.

What is claimed is:

1. A system for burning oil spill waste materials comprising:

a drum made of manually portable material suitable for sustaining the temperatures expected to be attained in the combustion of specific forms of waste materials, a removable lid for said drum made of said suitable material, a flue in said lid adapted for permitting the escape of the gases generated in the combustion of said waste materials and made of said suitable material, a mesh dome on said flue for preventing the escape of particles of a selected size and made of said suitable material, a hand truck, said drum being positioned on said hand truck, said hand truck including a panel secured thereto, said removable lid hinged to said panel so that it may be lowered to a close fit on the open end of said drum after said waste materials therein have been ignited, and clamping means on said lid for securing said lid to said drum, and means for creating a continuous cyclonic flow of air in said drum, including an electrically driven blower for creating a continuous flow of air mounted on said hand truck, and said blower including an air line made of stainless steel and said air line flexible within said flue and spiraled to follow the contour of said flue for a sector of substantially 270° said air line entering said drum adjacent its end so that a downward flow of forced air is created initially and a subsequent upward flow of air will carry gases and small particles toward and through said mesh dome, whereby upon ignition of said waste materials and attachment of said lid to said drum, a cyclonic flow of air will be created in said drum and operate to reduce to ashes substantially all of said waste materials.

2. A device for enabling materials used for cleaning up oil spills to be incinerated in situ comprising:

a drum made of a form of sheet suitable for withstanding the heat of combustion of selected oil spill waste materials, a lid for said drum for containing combusted materials therein;

a flue in said lid for permitting the escape of combusted materials, a mesh dome in said lid for screening combusted materials, means external to said drum for generating a continuous flow of air, and tubing means connected to said external generating means for directing said flow of air into said drum, said lid, said flue, said mesh dome and said tubing made of said form of sheet steel, said tubing means flexible and spiraled within said flue to create a cyclone in the air flow in said drum, said tubing means entering said drum adjacent its end for enhancing the downward spiral flow of air in said drum, whereby when waste material in said drum is combusted, said flow of air will create a cyclonic action so as to more thoroughly burn and reduce to ashes said waste material.

3. The device as defined in claim 2 wherein said form of sheet steel is stainless steel.

4. The device as defined in claim 3 and further including a hand truck and said means for generating a continuous flow of air is a blower mounted on said hand truck, whereby said oil drum may be transported manually to desired locations for burning in situ oil spill waste materials.

* * * * *